US009695835B2

(12) United States Patent
Mueller

(10) Patent No.: US 9,695,835 B2
(45) Date of Patent: Jul. 4, 2017

(54) SIDE CHANNEL LIQUID RING PUMP AND IMPELLER FOR SIDE CHANNEL LIQUID RING PUMP

(71) Applicant: Austin Wade Mueller, Clinton, WI (US)

(72) Inventor: Austin Wade Mueller, Clinton, WI (US)

(73) Assignee: Woodward, Inc., Fort Collins, CO (US)

( * ) Notice: Subject to any disclaimer, the term of this patent is extended or adjusted under 35 U.S.C. 154(b) by 797 days.

(21) Appl. No.: 13/962,008

(22) Filed: Aug. 8, 2013

(65) Prior Publication Data

US 2015/0044015 A1 Feb. 12, 2015

(51) Int. Cl.

| | |
|---|---|
| ***F04C 19/00*** | (2006.01) |
| ***F04D 29/18*** | (2006.01) |
| ***F04D 5/00*** | (2006.01) |
| ***F01C 21/08*** | (2006.01) |
| ***F04D 9/02*** | (2006.01) |

(52) U.S. Cl.

CPC ..... *F04D 29/188* (2013.01); *F01C 21/08* (2013.01); *F04C 19/007* (2013.01); *F04D 5/002* (2013.01); *F04D 9/02* (2013.01); *F04C 2210/1044* (2013.01); *F04C 2210/24* (2013.01); *F04C 2250/201* (2013.01)

(58) Field of Classification Search

CPC ..... F04B 25/00; F04C 19/00; B23P 17/00
USPC ..... 417/68, 430; 415/1, 55.1, 55.5
See application file for complete search history.

(56) References Cited

U.S. PATENT DOCUMENTS

| | | | | | |
|---|---|---|---|---|---|
| 1,920,484 | A | | 8/1933 | Siemen et al. | |
| 3,002,463 | A | | 10/1961 | Lahti | |
| 3,007,417 | A | | 11/1961 | Feltus | |
| 3,583,830 | A | * | 6/1971 | Bailey | F04C 19/001 417/215 |
| 4,804,313 | A | | 2/1989 | Nasvytis | |
| 5,096,386 | A | | 3/1992 | Kassel | |
| 5,961,295 | A | * | 10/1999 | Haavik | F04C 19/008 417/68 |

FOREIGN PATENT DOCUMENTS

| | | | | |
|---|---|---|---|---|
| CN | 102428281 | A | 4/2012 | |
| DE | 1940212 | A1 | 2/1971 | |
| DE | 8909839 | U1 * | 1/1991 | F01C 21/08 |
| EP | 0 889 243 | A1 | 1/1999 | |
| GB | 7438 | * | 0/1914 | |
| GB | 07438 | | 0/1915 | |

* cited by examiner

*Primary Examiner* — Mark A Laurenzi
*Assistant Examiner* — Shafiq Mian
(74) *Attorney, Agent, or Firm* — Reinhart Boerner Van Deuren P.C.

(57) ABSTRACT

A liquid ring pump is provided. The liquid ring pump is designed to reduce the overall envelop of the ring pump. The liquid ring pump includes a housing and an impeller. The housing defines an impeller cavity. The impeller cavity has an inlet port and a discharge port. The impeller is positioned within the impeller cavity for rotation about a central rotational axis. The impeller includes a central hub defining a conical outer surface and a plurality of angularly spaced apart main vanes extending radially outward from the conical outer surface relative to the central rotational axis. The inlet and discharge ports may be located on a same side of the impeller housing.

13 Claims, 5 Drawing Sheets

SIDE CHANNEL LIQUID RING PUMP AND IMPELLER FOR SIDE CHANNEL LIQUID RING PUMP

FIELD OF THE INVENTION

This invention generally relates to fuel pumps and particularly to liquid ring fuel pumps.

BACKGROUND OF THE INVENTION

In rotary wing aircraft, the engines are typically mounted in the top part of the aircraft while the fuel tanks are typically located in the bottom part. During operation, the engine main fuel pump has to lift the fuel from the tank. Gravity and inertial forces acting on the fuel substantially reduce the pressure at the inlet of the engine mounted fuel pump below the fuel pressure in the tank resulting in detrimental conditions for pump suction. The fuel pressure reduces even more when the aircraft flies at altitude, and the ambient air and tank pressures drop. The engine boost fuel pump has to possess exceptional suction capability to be able to induce the fuel from the inlet line at very low inlet pressures. In addition to this effect, due to rapid reduction in fuel pressure, the air, naturally dissolved in the fuel, evolves and travels toward the pump in form of air bubbles. Therefore, the fuel pump, in addition to its ability to induce the fuel at very low pressures, must also be able to induce air-fuel mixture with high air content.

For some rotary wing aircraft applications, the inlet line geometry and the operating conditions act to separate air bubbles from the fuel stream creating a non-homogeneous mixture of air and fuel, which can be in the form of intermittent air bubbles or a relatively large bubble of air. For the boost pump to meet these air handling requirements, the boost pump must be able to compress air. Further, the boost pump must be incorporated into a fuel system that can store the compressed air bubble and can prevent it from reaching the inlet to the main fuel pump.

Industrial applications, i.e. non-aircraft environments, have attempted to meet air pumping requirements by utilizing a side channel liquid ring pump. This type of pump is a hybrid that is able to provide pressures when operating on solid fuel that are on par with regenerative pumps but also has the capability to ingest and compress air.

When pumping air in a liquid ring pump, centrifugal forces separate the fuel and air (or vapor during low suction pressure conditions). The heavier fuel particles are flung to the outer diameter while the air bubbles collect near the impeller hub. A pressure gradient is established with the pressure in the channel at the outer diameter being greater than the pressure at the interior hub. The discharge port is located near the hub, away from the liquid ring.

Due to envelope constraints, such as in helicopters, the inlet and discharge ports may be co-located on one side of the impeller only. With a typical impeller, a non-symmetrical flow pattern results, which allows a pocket of air bubbles to collect on the impeller hub. The compressed air bubbles are carried through the seal zone into the inlet where the bubbles expand proportionally to the discharge/inlet pressure ration. This effect limits both air pumping and suction performance.

Embodiments of the present invention relate to improvements over the current state of the art.

BRIEF SUMMARY OF THE INVENTION

Embodiments of the present invention provide a new and improved liquid ring pump. Embodiments of the present invention provide a new and improved impeller for a liquid ring pump. Embodiments of the present invention provide new and improved methods of pumping air and liquids.

In one embodiment, an impeller for a liquid ring pump includes a central hub defining a conical outer surface and a plurality of angularly spaced apart main vanes extending radially outward from the conical outer surface. The conical shape of the outer surface of the central hub creates a pressure drop across the outer surface to assist in preventing air bubbles from attaching to the central hub.

In one embodiment, the impeller includes a reinforcing ring connecting distal end portions of adjacent main vanes.

In one embodiment, the central hub defines a central rotational axis about which the impeller rotates. The reinforcing ring is axially positioned between a port side of the main vanes and a back side, opposite the port side of the main vanes.

In one embodiment, the impeller includes a plurality of secondary vanes extending axially from the reinforcing ring. The secondary vanes are spaced radially outward from the conical outer surface of the central hub.

In one embodiment, the main vanes and secondary vanes alternate angularly about the central rotational axis such that a secondary vane is positioned angularly between adjacent main vanes.

In another embodiment, a liquid ring pump is provided. The liquid ring pump is designed to reduce the overall envelop. The liquid ring pump includes an impeller housing and an impeller. The impeller housing defines an impeller cavity. The impeller cavity has an inlet port and a discharge port. The impeller is positioned within the impeller cavity for rotation about a central rotational axis. The impeller includes a central hub defining a conical outer surface and includes a plurality of angularly spaced apart main vanes extending radially outward from the conical outer surface relative to the central rotational axis.

The impeller can take more particular forms such as those outlined above.

In one embodiment, the inlet and discharge ports are located on a same side of the impeller.

In one embodiment, the conical outer surface of the central hub has a first radius proximate a port side of the impeller and the conical outer surface of the central hub has a second radius proximate a back side of the impeller. The back side is axially spaced apart from the port side along the central rotational axis. The first radius is smaller than the second radius.

In one embodiment, the inlet and discharge ports of the impeller housing are located proximate the port side of the impeller and are axially spaced away from the back side of the impeller along the central rotational axis.

In one embodiment, the impeller housing defines a side channel in a portion of the radial periphery thereof.

In one embodiment, a method of pumping an air/fuel mixture is provided. The method includes receiving fuel and air through an inlet port of an impeller housing of a liquid ring pump; discharging the fuel and air through a discharge port of the impeller housing; creating a pressure differential along a conical outer surface of a central hub of an impeller located within an impeller cavity of the impeller housing for rotation about a central rotational axis, the impeller cavity being in fluid communication with the inlet port and discharge port, the impeller including a plurality of main vanes extending radially outward from the conical outer surface relative to the central rotational axis.

In a more particular method, the conical outer surface of the impeller has a first radius proximate the discharge port and a second radius spaced axially away from the discharge port along the central rotational axis. The second radius is greater than the first radius.

In one embodiment, the pressure differential reduces in pressure when moving along the conical surface from the second radius toward the first radius.

In one embodiment, the inlet and discharge ports of the impeller housing are located proximate a port side of the impeller and are axially spaced away from a back side of the impeller along the central rotational axis. The port side is proximate the first radius and the back side being proximate the second radius.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
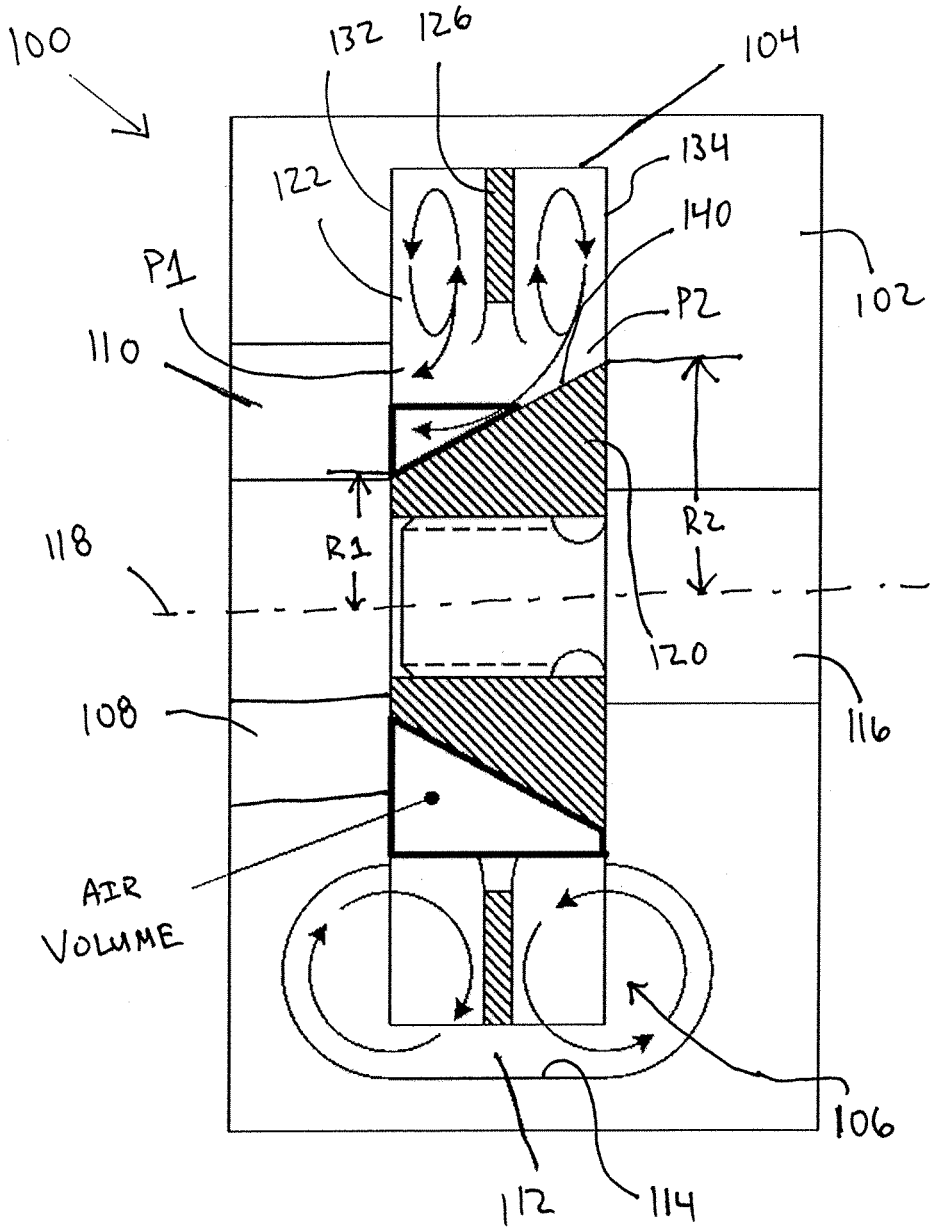
FIG. 1 is a simplified cross-sectional illustration of a liquid ring pump according to an embodiment of the invention.
Figure 2:
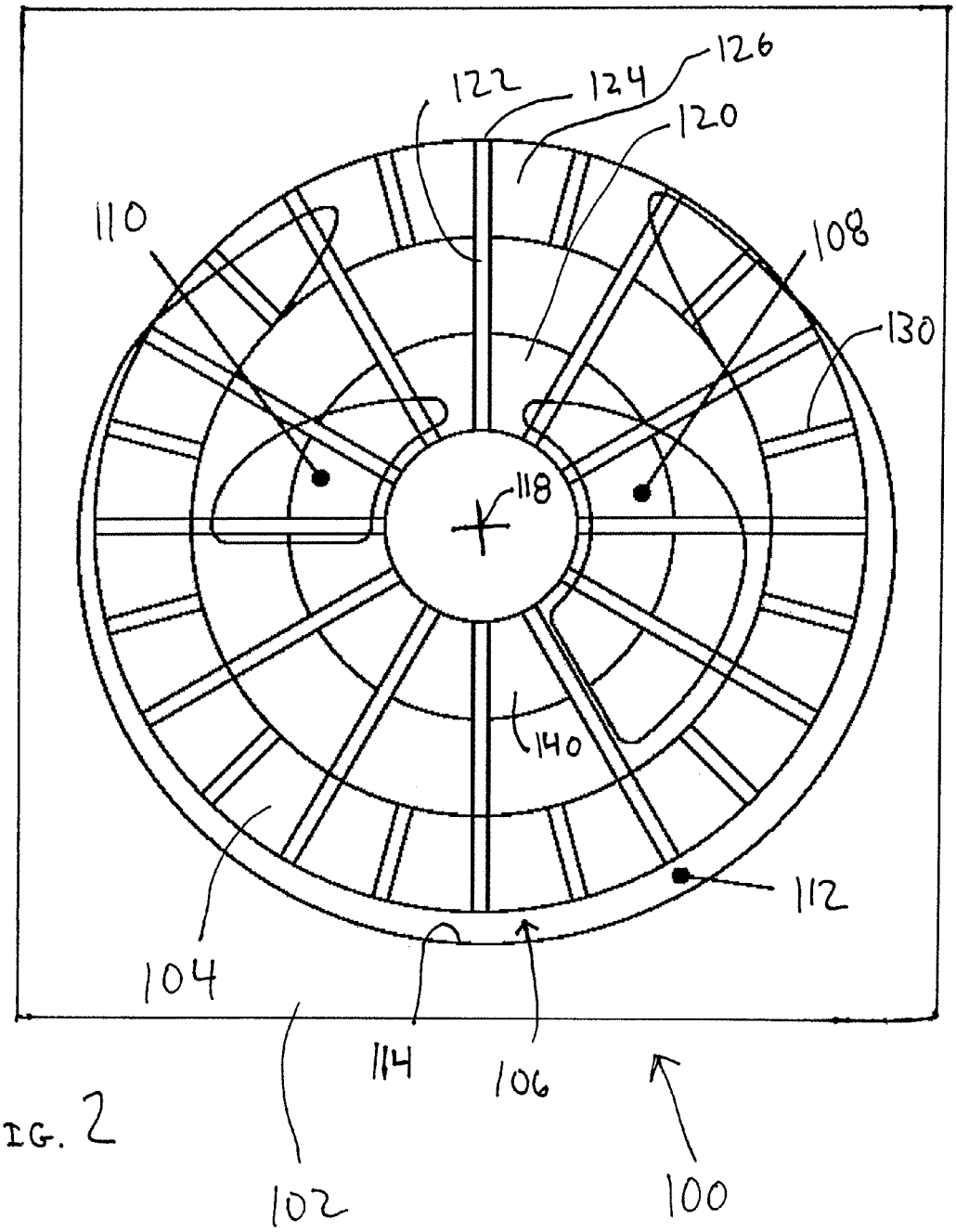
FIG. 2 is a further cross-sectional illustration of the liquid ring pump of FIG. 1.
Figure 3:
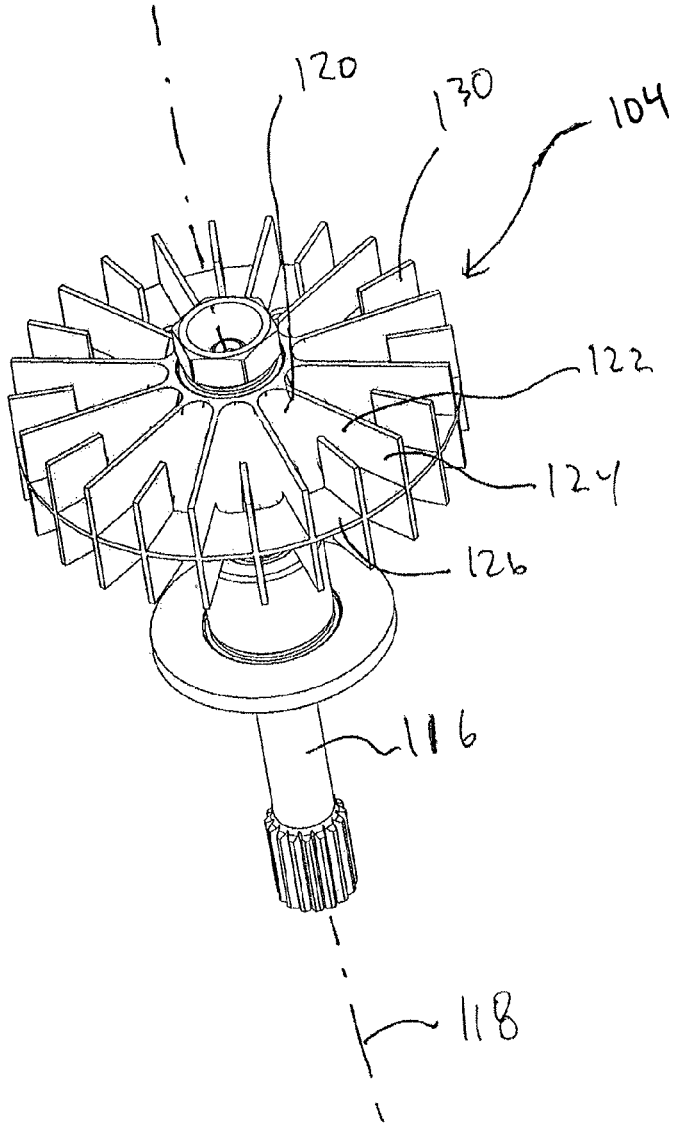
FIG. 3 is a top perspective illustration of the impeller of the liquid ring pump of FIG. 1.
Figure 4:
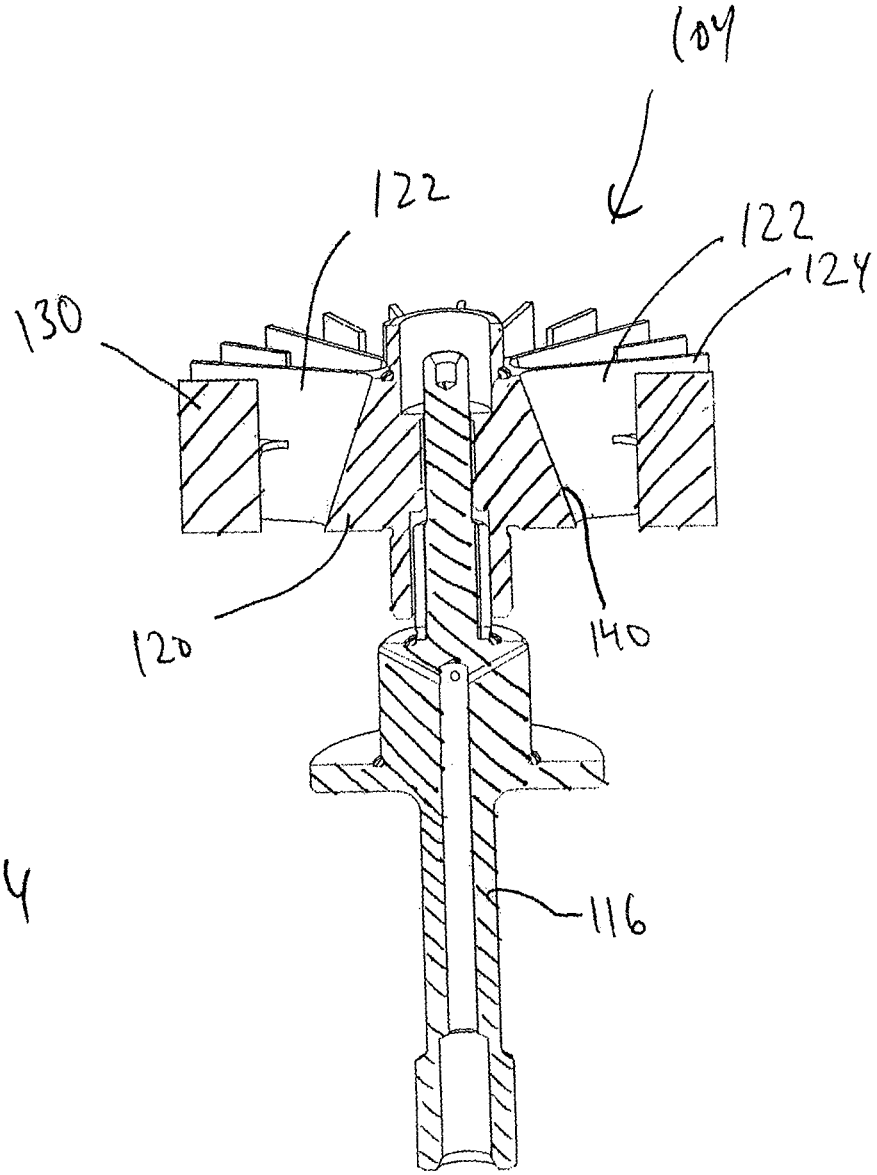
FIG. 4 is a cross-sectional illustration of the impeller of FIG. 3.
Figure 5:
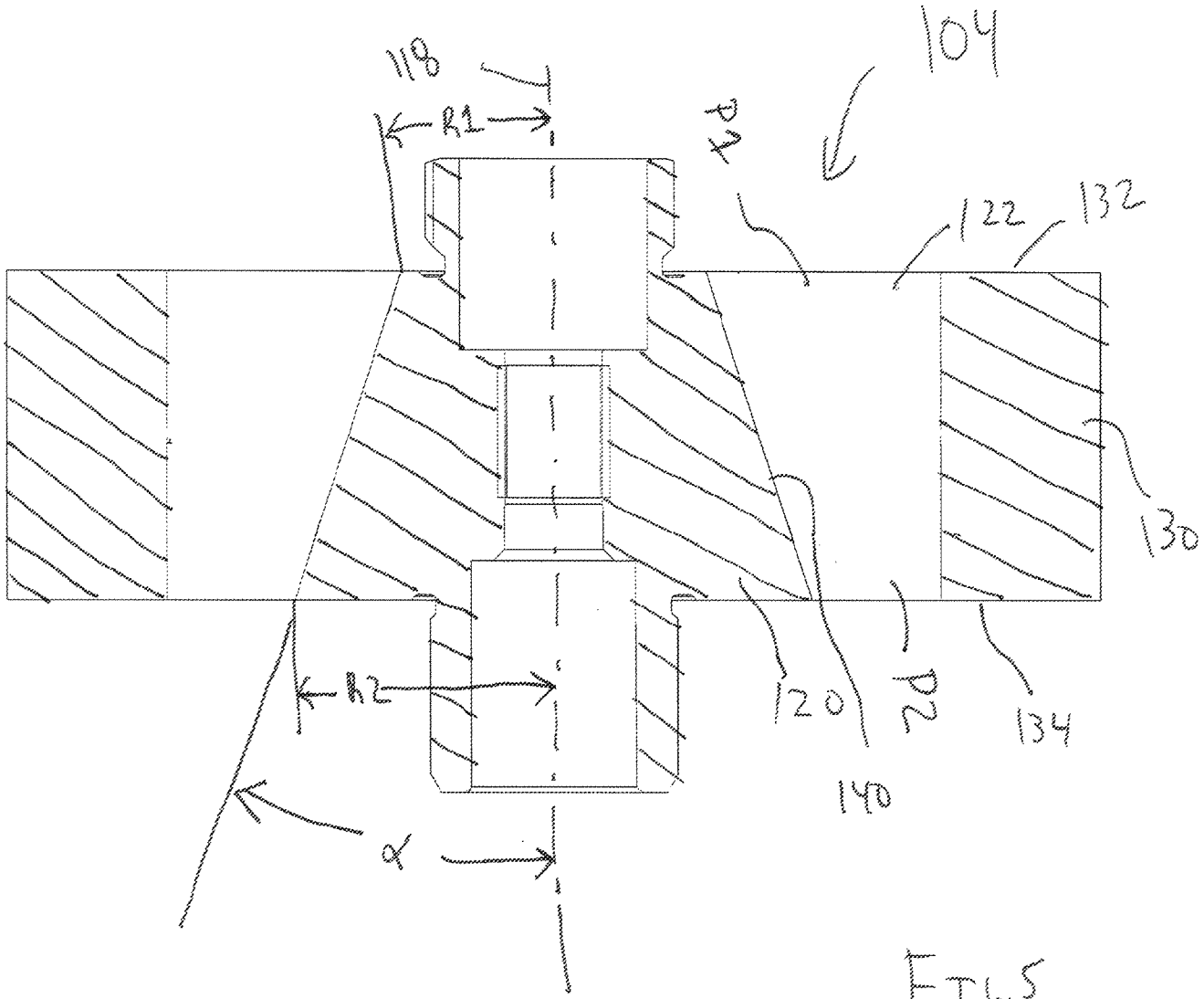
FIG. 5 is an enlarged cross-sectional illustration of the impeller of FIG. 3.

FIGS. 1 and 2 are simplified cross-sectional illustrations of an embodiment of a side channel liquid ring pump 100 (also referred to as "pump 100") according to an embodiment of the present invention. The pump 100 is designed to draw suction and pump both liquids and gases as well as mixed gas and liquids. The pump 100 finds particular applicability in fuel systems and particularly fuel systems for aircraft such as helicopters.

The pump 100 includes a housing 102 that houses impeller 104 within a cavity 106 of the housing 102. The housing 102 includes an inlet port 108 and a discharge port 110. The cavity 106 defines a side channel 112 in portion of the radially outer periphery 114 of cavity 106. The inlet and discharge ports 108, 110 are located on a same side of the impeller 104 so as to reduce the size of the pump 100 and to make it more suitable for use on aircraft and particularly helicopters.

The impeller 104 is operably attached to an input shaft 116 that rotates the impeller 104 about a central rotational axis 118.

The impeller 104 includes a central hub 120 from which a plurality of angularly spaced apart primary vanes 122 extend radially outward. Distal end portions 124 of the primary vanes 122 are angularly attached by a reinforcement ring 126. A plurality of secondary vanes 130 are also attached to the reinforcement ring 126. The impeller 104 is configured such that the vanes alternate angularly between a primary vane 122 and a secondary vane 130 such that each pair of adjacent primary vanes 122 has a corresponding secondary vane 130 positioned angularly therebetween.

The impeller has a port side 132 and a back side 134 opposite the port side 132 such that the port side 132 and back side 134 are axially spaced apart along central rotational axis 118. The port side 132 is positioned adjacent to the inlet and discharge ports 108, 110.

The central hub 120 tapers radially outward relative to central rotational axis 118 when moving axially along the central rotational axis 118 from the port side 132 to the back side 134 at an angle $\alpha$. This conical angled geometry for the central hub 120 improves the air pumping capabilities and prevents air pockets from collecting on the central hub 120. The radius R1 of the central hub 120 proximate the port side 132 is smaller than the radius R2 of the central hub 120 proximate the back side 134.

As the impeller 104 rotates about central rotational axis 118 the heavier fuel (e.g. liquid) particles are accelerated on the radius and flung radially outward toward the outer radial periphery 114 of the impeller cavity 106 causing an air within the fluid flow to collect near the central hub 120. A pressure gradient is established with the pressure in the side channel 112 greater than proximate the pressure at the hub.

The angle $\alpha$ of the outer surface of the central hub 120 is set such that a pressure gradient is developed on the outer surface 140 of the central hub 120 from P1 to P2, which is defined by the rotational speed of the impeller and the hub radius at each location. Due to the angle $\alpha$, P2 is greater than P1. When operating on a mixed flow, i.e. a flow with both fuel and air, the heavier fuel particles will migrate to P2, forcing the air bubbles toward the port side 132 and P1. This also draws the air bubbles closer to the discharge port 110, where the air may then be swept into the discharge port 110.

By being able to locate both the inlet and discharge ports 108, 110 on the same side of the housing 102, the envelope of the system can be significantly reduced.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An impeller for a liquid ring pump comprising:

a central hub defining a conical outer surface;

a plurality of angularly spaced apart main vanes extending radially outward from the conical outer surface, and wherein the conical outer surface of the impeller has a first end having a first radius and a second end having a second radius, the second radius being greater than the first radius, a reinforcing ring connecting distal end portions of adjacent main vanes;

wherein the reinforcing ring being axially positioned between a port side of the main vanes and a back side, opposite the port side of the main vanes of the impeller, and wherein the impeller is positioned in an impeller cavity of a liquid ring pump housing.

2. The impeller of liquid ring pump of claim 1, wherein the central hub defines a central rotational axis about which the impeller rotates.

3. The impeller of claim 1, further comprising a plurality of secondary vanes extending axially from the reinforcing ring, the secondary vanes being spaced radially outward from the conical outer surface of the central hub.

4. The impeller of claim 3, wherein the main vanes and secondary vanes alternate angularly about the central rotational axis such that a secondary vane is positioned angularly between adjacent main vanes.

5. A liquid ring pump comprising:

a housing defining an impeller cavity, the impeller cavity has an inlet port and a discharge port;

an impeller positioned within the impeller cavity for rotation about a central rotational axis, the impeller including:

a central hub defining a conical outer surface; and a plurality of angularly spaced apart main vanes extending radially outward from the conical outer surface relative to the central rotational axis, and wherein the conical outer surface of the impeller has a first radius proximate a port side of the impeller and the conical outer surface of the central hub has a second radius proximate a back side of the impeller, the back side being axially spaced apart from the port side along the central rotational axis, the first radius being smaller than the second radius, a reinforcing ring connecting distal end portions of adjacent main vanes;

wherein the reinforcing ring being axially positioned between the port side of the main vanes and the back side, opposite the port side of the main vanes of the impeller.

6. The liquid ring pump of claim 5, further comprising a plurality of secondary vanes extending axially from the reinforcing ring, the secondary vanes being spaced radially outward from the conical outer surface of the central hub.

7. The liquid ring pump of claim 6, wherein the main vanes and secondary vanes alternate angularly about the central rotational axis such that a secondary vane is positioned angularly between adjacent main vanes.

8. The liquid ring pump of claim 5, wherein the inlet and discharge ports are located on a same side of the impeller.

9. The liquid ring pump of claim 8, wherein the inlet and discharge ports of the impeller housing are located proximate the port side of the impeller and are axially spaced away from the back side of the impeller along the central rotational axis.

10. The liquid ring pump of claim 5, wherein the impeller housing defines a side channel in a radial periphery thereof.

11. A method of pumping an air/fuel mixture comprising:

receiving a fuel and air through an inlet port of an impeller housing of a liquid ring pump; wherein the liquid ring pump has a reinforcing ring;

discharging the fluid through a discharge port of the impeller housing;

creating a pressure differential along a conical outer surface of a central hub of an impeller located within an impeller cavity of the impeller housing for rotation about a central rotational axis, the impeller cavity being in fluid communication with the inlet port and discharge port, the impeller including a plurality of main vanes extending radially outward from the conical outer surface relative to the central rotational axis, and wherein the conical outer surface of the impeller has a first radius proximate the discharge port and a second radius spaced axially away from the discharge port along the central rotational axis, the second radius being greater than the first radius.

12. The method of claim 11, wherein the pressure differential reduces in pressure when moving along the conical surface from the second radius toward the first radius.

13. The method of claim 11, wherein the inlet and discharge ports of the impeller housing are located proximate a port side of the impeller and are axially spaced away from a back side of the impeller along the central rotational axis, the port side being proximate the first radius and the back side being proximate the second radius.

* * * * *